United States Patent [19]

Lespérance

[11] Patent Number: 4,700,404

[45] Date of Patent: Oct. 20, 1987

[54] GOALKEEPER GLOVE

[76] Inventor: François Potvin, 51 Rochelle Drive, Guelph, Ontario, Canada, N1K 1G6

[21] Appl. No.: 932,664

[22] Filed: Nov. 20, 1986

[51] Int. Cl.[4] ..... A41D 13/10

[52] U.S. Cl. ..... 2/16; 2/161 A

[58] Field of Search ..... 2/16, 161 A

[56] References Cited

U.S. PATENT DOCUMENTS

| | | | |
|---|---|---|---|
| 1,841,193 | 1/1932 | Lidston | 2/16 |
| 3,605,117 | 9/1971 | Latina | 2/16 |
| 3,626,515 | 12/1971 | Murray | 2/161 A |
| 4,027,339 | 6/1977 | Brucker | 2/16 |
| 4,137,572 | 2/1979 | Jansson et al. | 2/161 A |

*Primary Examiner*—Louis K. Rimrodt

[57] ABSTRACT

A goalkeeper glove known as a blocker, more particularly for use in the game of hockey, wherein the back of the glove itself is attached to a generally rectangular shielding pad, having an outer wall adapted to be impacted by a hockey puck during the game. The pad outer wall has a slight and uniform curvature, starting from its front end portion, which protrudes from the finger sheaths of the hockey glove and in the direction of the rear end portion of said outer wall, said rear end portion making a pronounced angle and protruding outwardly from said outer wall, said angle being adjustable by the goaltender, so that he may choose the amount of deflection of a hockey puck impacting on said outer wall and moving rearwardly and deflected by said inclined rear end portion. Therefore, the puck can be deflected ahead of the goalkeeper, so that he will have more time to prepare himself to stop the next shot from the players of the opposite team.

7 Claims, 4 Drawing Figures

GOALKEEPER GLOVE

FIELD OF THE INVENTION

The present invention relates to a goalkeeper blocker, more particularly to such a glove used in the game of ice-hockey.

BACKGROUND OF THE INVENTION

It is known to provide a goalkeeper glove for the game of ice-hockey, in which at the back of the glove is attached a blocker pad, of rectangular shape, extending longitudinally of the glove with said pad defining an outer wall, which is generally straight transversely thereof and which has a slight but uniform curvature longitudinally thereof. These gloves are designed to control the reflected direction of a hockey puck impacting on the same. However, when a puck shot is directed at a narrow angle with respect to the shielding pad, it will also be deflected at a narrow angle in an area close to and laterally from the goalkeeper cage where it is easier for a player of the opposite team to pick up the puck and shoot another time at the goaltender.

OBJECTS OF THE INVENTION

It is therefore the main object of the present invention to provide a goaltender glove of the character described, wherein means are provided on said shielding pad to deflect the puck at a greater angle, so that it may fall back on the ice at a greater distance forwardly of the goalkeeper, so that himself, or his co-players on the defensive; may have better puck control as against the players of the opposite team.

Another object of the invention is to provide a goalkeeper glove of the character described, in which the rear end portion of the shielding pad makes an angle with the major portion of said pad to provide for more pronounced puck deflection.

Another object of the invention is to provide a glove of the character described, wherein the goalkeeper himself may adjust the amount of inclination of the rear end portion with respect to the major portion of the outer wall of the shielding pad to suit his specific requirement.

SUMMARY OF THE INVENTION

In accordance with the invention, there is provided the combination of a goalkeeper glove having a hand inlet opening at one end and finger sheaths at the other end, with a blocker pad attached to the back of the glove, the pad having an outer wall, of generally rectangular shape, and facing away from the glove, a front end portion, a major intermediate portion and a rear end portion; the front end portion and the rear end portion protruding from the finger sheaths and the hand inlet opening, respectively, the outer wall of the pad being generally straight, transversely thereof, and being longitudinally curved, the radius of curvature of the outer wall being substantially uniform throughout the length of the front end portion and major intermediate portion, the rear end portion being inclined relative to the major intermediate portion and protruding from said outer wall; the rear end portion may make a maximum angle of one hundred and thirty-five degrees with the major intermediate portion. When the angle is more than ninety degrees, the outer wall junction portion between the rear end portion and the intermediate major portion must have a radius of curvature greater than that of a hockey puck, so as not to trap the puck. Preferably, the angle made by the rear end portion with respect to the major intermediate portion can be selectively varied to suit the goaltender's individual requirement. In this case, the sheaths enclosing pad material may open at the rear end portion of the outer wall, to permit insertion of a variable mumber of wedge-shape nembers, in order to obtain the desired inclination.

DETAILED DESCRIPTION OF THE PREFERRED EMBODIMENT

Figure 1:
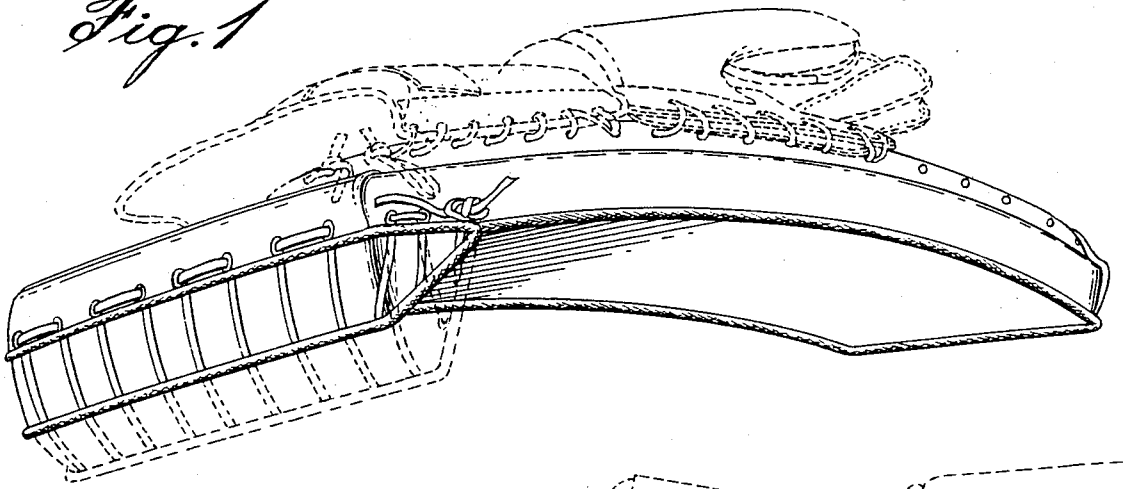
FIG. 1 is a perspective view of the blocker pad in accordance with the invention, shown attached to the back of a goalkeeper glove, shown in dotted line.
Figure 2:
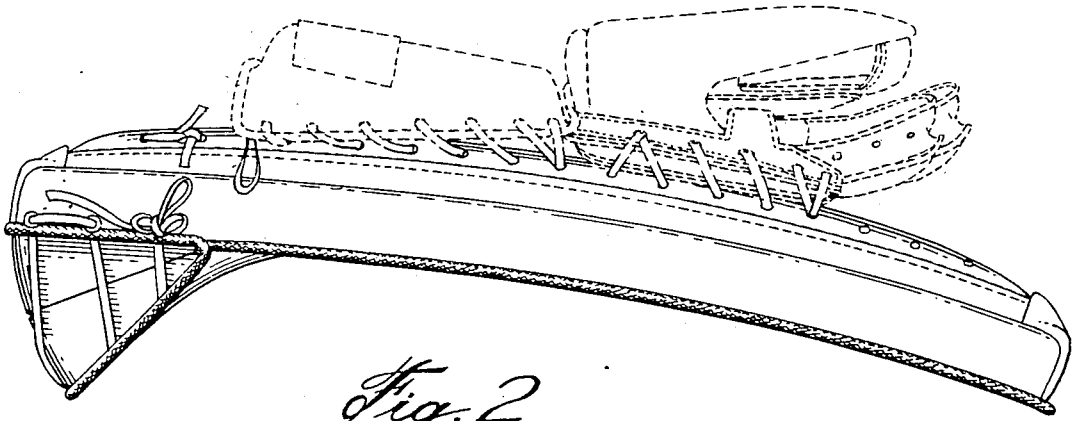
FIG. 2 is a side elevation, partially in section, of the combination shown in FIG. 1.
Figures 3, 4:
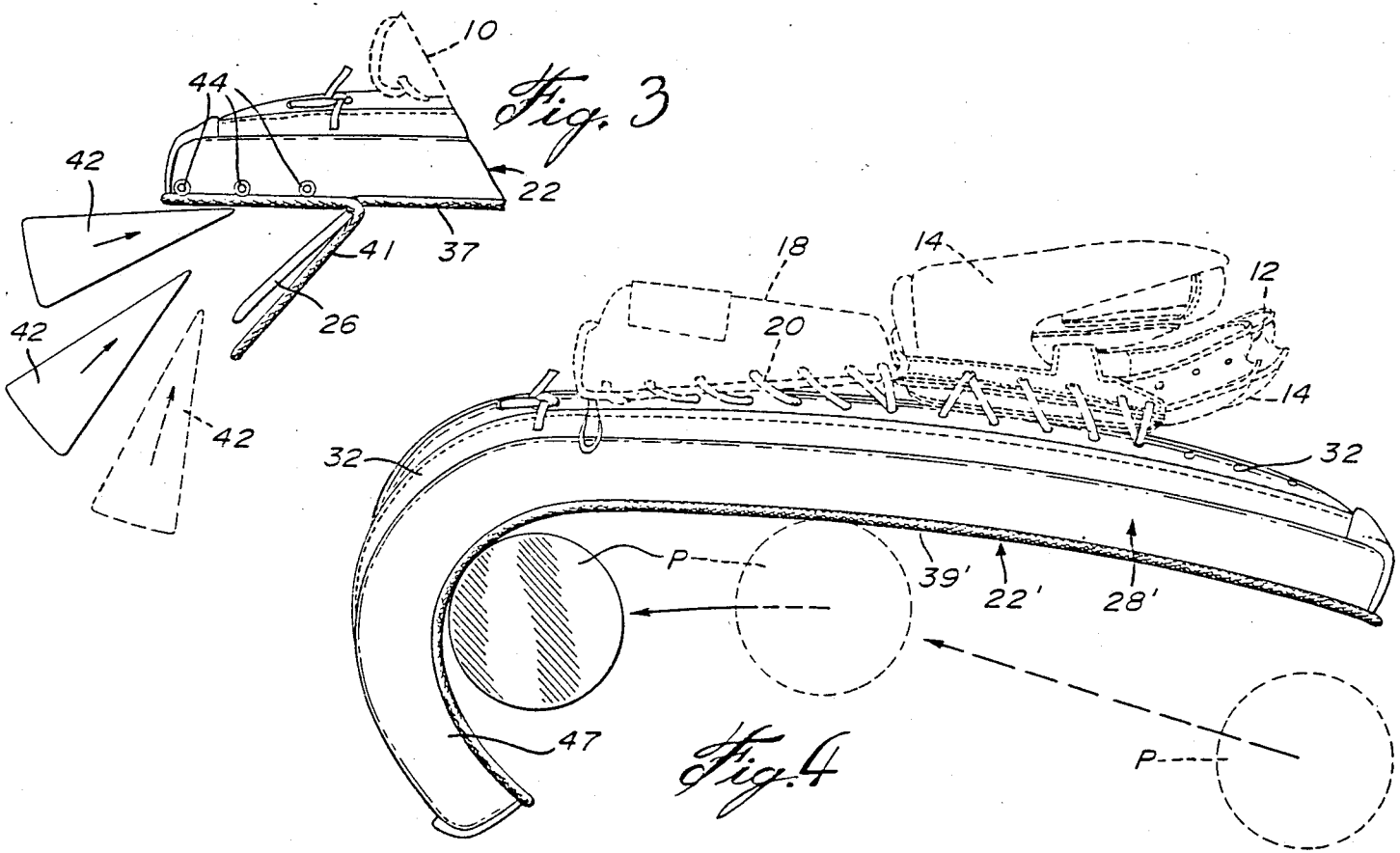
FIG. 3 is a partial side elevation of the rear end portion of the blocker pad of FIG. 2, showing how a variable number of wedge members can be inserted within the rear end portion of the pad to vary the inclination of the rear end portion of the outer face of the pad.
FIG. 4 is a partial side elevation of another embodiment in which the rear end portion of the shielding pad is curved at about one hundred and thirty-five degrees, to more strongly deflect a hockey puck, shown in full line and also in dotted line, in the process of striking and being deflected by the blocker pad.

The combined goalkeeper glove and blocker pad of the first embodiment is shown in FIGS. 1, 2, and 3. The glove 10 proper is of conventional construction, including a hand inlet opening 11 at one end; an individual finger sheath 12 at the opposite end, the latter provided with small shielding pads 14. The glove includes the glove portion 16 designed to enclose the palm and back of of the user's hand and a glove section 18 designed to enclose the end of the forearm of the user. The back side of the glove portion 16 and glove sleeve 18 are tied by adjustable flexible lace 20 to an intermediate portion of a generally rectangular blocker pad 22, which protrudes from the ends and sides of glove 10. The blocker pad 22 consists of a backing core, of synthetic resin 24, such as a foam plastic, of uniform thickness, for shock absorption, and a sturdy outer plastic panel 26 to spread the impact, both enclosed within a sheath 38, of flexible material, such as leather or the like. Sheath 28 defines an inner wall 30 to which glove 10 is attached, an outer wall 32, side walls 33, a front end wall 34 on the side of finger sheaths 12 and an opposite rear end wall 36 protruding from the inlet opening 11 of the glove 10. Backing core 24 and plastic panel 26 are generally co-extensive with the rectangular outer wall 32.

The above-defined construction is conventional. In the conventional structure, the wall 32 is stitched all around to side walls 33 and to both end walls 34, 36 and the protruding edge of outer wall 32 is covered by an edging strip 37. In accordance with the invention, the outer wall 32, instead of being of the same slight uniform radius of longitudinal curvature throughout its length, has a rear end portion 38, which makes a pronounced angle and which protrudes outwardly from the major intermediate portion 39 of said outer wall 32. Conventionally, the intermediate portion 39 smoothly merges with the front end portion 40 of the outer wall 32.

In the embodiment of FIGS. 1, 2, and 3, the rear end portion 38 of the outer wall 32 is not directly attached to the rear end portions of the side walls 33 and to the rear end wall 36, and the free edges of said wall portions are covered by an edging strip 41. Rear end portion 38 forms a flexible flap, depending from the remaining portion of the outer wall. As shown in FIG. 3, one or more wedge members 42 can thus be inserted within the opening of the sheath 28, thereby provided by the openable flap, so as to be sandwiched between the main core 24 and the flexible flap 38, core 24 being preferably provided with a transverse groove 25 for increased flexibility at the zone of maximum curvature. Preferably, the wedge members 42 are made of the same impact-absorbing material as that of core 24, such as a foamed plastic, such as foam polystyrene.

Upon a defined number of wedge members 42 have been inserted, they are retained in position by threading a lace 43 alternately through eyelets 44 extending along the free edge of the rear end wall 36 and the rear end portion of the free edge of the side walls 33 and also along the free edge of the flap 38 of outer wall 32. The lace 43 is tightened and tied into a knot 45, as shown. Preferably, the wedge members 42 are hidden from view by being covered by flexible leather cover parts 46 extending from the edges of the rear portion of the sheaths 28 and flap 38 of the outer wall 32, and arranged in overlapping relationship, as shown in FIG. 2, to provide for cover of a variable number of wedge members 42, of different angles. The wedge members 42 extend transversely of the core member 24 and have a length substantially equal to the width of said core 24.

Referring to FIGS. 1 and 2, it is clear that a hockey puck hitting the blocking pad 22 and coming at a small angle from a direction opposite to the user's forearm will hit the blocking pad 22 and be deflected by the inclined rear end portion 38 of the outer wall 32 in a much more forward direction than if such an inclined rearward portion was absent. The amount of increased deflection can be selected in accordance with the glove user's specific wishes.

The second embodiment, shown in FIG. 4, shows that the inclination of the rear end portion of the pad can be such as to form a hook-shape member with a maximum angle of about one-hundred and thirty-five degrees. In this case, the panel 26, not shown in FIG. 4, which is inside the sheath 28', is preformed to the required shape and the core material is also preformed to the required shape. In this case, the puck P, which bounces off the major intermediate portion 39' of the blocking pad 22', will strike and fall practically in front of the goaltender.

In this embodiment, the hook-shaped rear portion 47 must have a radius of curvature greater than the radius of the puck P, to prevent trapping of the puck within the blocking pad 22'.

What I claim is:

1. The combination of a goaltender glove having a hand inlet opening at one end and finger sheaths at the other end, with a blocking pad attached to the back of said glove, said pad having an outer wall, of generally rectangular shape, and facing away from said glove, said outer wall having a front end portion, a major intermediate portion and a rear end portion, said front end portion and said rear end portion protruding from said finger sheaths and hand inlet opening, respectively, said outer wall being generally straight transversely thereof, and being longitudinally curved, the radius of curvature of said outer wall being substantially uniform throughout the length of said front end portion and major intermediate portion, respectively, said rear end portion being inclined relative to said major intermediate portion and protruding from said outer wall.

2. The combination as defined in claim 1, wherein said rear end portion makes a maximum angle of one hundred and thirty-five degrees with said major intermediate portion.

3. The combination as defined in claim 2, wherein said rear end portion is longitudinally curved and has a greater radius of curvature than that of a hockey puck.

4. The combination as defined in claim 1, wherein said pad includes a flexible sheath defining said outer wall and also side walls and front and rear end walls, a backing core, of impact-absorbing material, said core being of uniform thickness, and a flexible panel, of impact-spreading material, said core and panel located within said sheath and generally co-extensive with said outer wall, said panel disposed intermediate said core and said outer wall, said outer wall being attached to said front end wall and to a major portion of said side walls, except at its rear end portion, whereby the latter defines a flap, at least one wedge member, of impact-absorbing material, disposed between said core and panel in register with said flap and means to adjustably secure said flap to said rear end wall and to rear end portions of said side walls.

5. The combination as defined in claim 4, wherein said last-named means includes a lace threaded in a zigzag manner through eyelets at the edges of said flap of said rear end wall and of the rear end portions of said side walls, respectively.

6. The combination as claimed in claim 5, further including overlapping cover means depending from the free edge of said flap and from the edge of said rear end wall and rear end portion of said side walls, respectively, for covering said panel wedge member and core.

7. The combination as claimed in claim 4, wherein the inclination of said outer wall rear end portion with respect to said major intermediate portion can be varied by varying the number of wedge members located between said panel and said core.

* * * * *